US009295336B2

(12) United States Patent
Driscoll, Jr. et al.

(10) Patent No.: US 9,295,336 B2
(45) Date of Patent: Mar. 29, 2016

(54) INFLATING AN AIR MATTRESS WITH A BOUNDARY-LAYER PUMP

(75) Inventors: David Delory Driscoll, Jr., Milwaukee, WI (US); John Joseph Riley, Brookfield, WI (US)

(73) Assignee: RAPID AIR LLC, Pewaukee, WI (US)

( * ) Notice: Subject to any disclaimer, the term of this patent is extended or adjusted under 35 U.S.C. 154(b) by 724 days.

(21) Appl. No.: 13/426,359

(22) Filed: Mar. 21, 2012

(65) Prior Publication Data

US 2012/0240340 A1 Sep. 27, 2012

Related U.S. Application Data

(60) Provisional application No. 61/454,888, filed on Mar. 21, 2011.

(51) Int. Cl.
*A47C 27/10* (2006.01)
*F04D 17/16* (2006.01)
*A47C 27/08* (2006.01)

(52) U.S. Cl.
CPC ..... *A47C 27/10* (2013.01); *A47C 27/082* (2013.01); *F04D 17/161* (2013.01)

(58) Field of Classification Search
CPC .. A47C 27/081; A47C 27/082; A47C 27/083; A47C 27/10; A61G 7/05769; A61G 7/05776; F04D 17/161; F04D 25/084
USPC ..... 5/706, 710, 713, 655.3; 417/315
See application file for complete search history.

(56) References Cited

U.S. PATENT DOCUMENTS 3,477,071 A * 11/1969 Emerson ..... 5/609
3,628,894 A 12/1971 Ferguson, Jr.
4,025,225 A * 5/1977 Durant ..... 415/90
4,402,647 A * 9/1983 Effenberger ..... 415/90
4,829,616 A 5/1989 Walker
5,343,893 A 9/1994 Hogan et al.
5,487,196 A 1/1996 Wilkinson et al.
5,588,811 A 12/1996 Price
6,698,046 B1 3/2004 Wu
7,246,394 B2 7/2007 Wang
7,588,425 B2 9/2009 Chung
7,784,131 B2 8/2010 Genaro et al.
2002/0119040 A1 8/2002 Bosley
2008/0127423 A1 6/2008 Gammons
2011/0073202 A1 3/2011 Feingold et al.

OTHER PUBLICATIONS

International Search Report for co-pending International Patent Application No. PCT/US2012/29977 dated Jul. 24, 2012.
International Search Report for co-pending International Patent Application No. PCT/US2012/41114 dated Aug. 24, 2012.

* cited by examiner

*Primary Examiner* — Nicholas Polito
(74) *Attorney, Agent, or Firm* — Leydig, Voit & Mayer, Ltd.

(57) ABSTRACT

An airbed system is provided. The airbed system includes: an air mattress having at least one air mattress chamber; a boundary-layer pump connected to the at least one air mattress, configured to fill the at least one air mattress with gas; and a control unit, configured to receive user input corresponding to increasing or decreasing the pressure in the at least one air mattress chamber and to control the boundary-layer pump based on the received user input. The boundary-layer pump includes: a pressure recovery chamber housing including a pressure recovery chamber, a pump inlet, and a pump outlet; a plurality of disks within the pressure recovery chamber; and a motor attached to the plurality of disks, configured to rotate the plurality of disks so as to expel gas passing through the pump inlet radially outwards along the disks and out through the pump outlet.

17 Claims, 14 Drawing Sheets

INFLATING AN AIR MATTRESS WITH A BOUNDARY-LAYER PUMP

CROSS-REFERENCE TO RELATED APPLICATIONS

This patent application claims the benefit of U.S. Provisional Patent Application No. 61/454,888, filed on Mar. 21, 2011, which is incorporated by reference.

BACKGROUND

Commercial airbeds have been growing steadily in popularity. Many types of airbeds have been developed for a variety of applications over the years, ranging from simple and inexpensive airbeds that are convenient for temporary use (such as for house guests and on camping trips), home-use airbeds that replace conventional mattresses in the home, to highly sophisticated medical airbeds with special applications (such as preventing bedsores for immobile patients). With respect to home-use and medical airbeds, more and more consumers are turning to these types of airbeds for the flexibility in firmness that they offer, allowing consumers to adjust their mattresses to best suit their preferences.

Conventional home-use and medical airbeds generally include at least a few main components: a mattress with at least one chamber that can be filed with air, a unit for pumping air into the chamber, and appropriate connections between the mattress and the pumping apparatus. The pumping unit may further include a pump connected to a manifold, with a control mechanism and valves for controlling the pumping of air into the mattress and releasing the air out of the mattress. Conventional pumps used in airbeds are "squirrel-cage" blowers and diaphragm pumps.

The squirrel-cage blowers used in airbeds are relatively inexpensive and simple pumps that rely on a fan to push air into the mattress. While the squirrel-cage blower is able to achieve a relatively high flow rate (e.g. around 75 L/min) and inflate a mattress relatively quickly, it is unable to produce pressures that are high enough to meet the desirable range of pressure for all home-use and medical airbeds (up to about 1 psi), as squirrel-cage blowers are generally limited to about 0.1-0.5 psi. Squirrel-cage blowers tend to be inefficient and therefore will generate higher levels of heat when they are running compared to diaphragm pumps.

The diaphragm pumps used in airbeds, which rely on quasi-positive displacement technology, are generally able to achieve pressures of up to about 5 psi, well beyond the requirements of the airbed industry. However, diaphragm pumps are not capable of as much air flow as squirrel-cage blowers (limited to about 25-50 L/min), and thus take a longer amount of time to fill an air mattress. Diaphragm pumps also generate a moderate amount of noise, but less than squirrel-cage blowers. Diaphragm pumps, for the same relative performance as a squirrel-cage blower, will be two to three times more expensive.

More sophisticated airbeds used in medical applications (e.g. home-care airbeds) have been able to deal with these problems to some degree by integrating both a diaphragm pump and a squirrel cage blower in their airbeds, as well as adding a noise-cancelling housing to encase the pumps. These medical airbeds can start off by filling the airbed quickly at a low pressure with a squirrel cage blower, and switch over to a diaphragm pump to finish the filling and achieve the desired pressure. Additionally, medical airbeds may take into account whether the patient on the bed is asleep or awake in determining which pump to use (e.g. using the noisier squirrel cage pump for rolling over a patient that is awake, or using the relatively quieter diaphragm pump for supplying a constant flow for a wound-care type mattress running while the patient is asleep). However, these solutions result in a steep increase in cost, as well as increasing the size and complexity of the entire pumping unit.

It will be appreciated that the foregoing is a discussion of problems discovered and/or appreciated by the inventors, and is not an attempt to review or catalog the prior art.

SUMMARY

In an embodiment, the present invention provides an airbed system. The airbed system includes: an air mattress having at least one air mattress chamber; a boundary-layer pump connected to the at least one air mattress, configured to fill the at least one air mattress with gas, and a control unit, configured to receive user input corresponding to increasing or decreasing the pressure in the at least one air mattress chamber and to control the boundary-layer pump based on the received user input. The boundary-layer pump includes: a pressure recovery chamber housing including a pressure recovery chamber, a pump inlet, and a pump outlet; a plurality of disks within the pressure recovery chamber; and a motor attached to the plurality of disks, configured to rotate the plurality of disks so as to expel gas passing through the pump inlet radially outwards along the disks and out through the pump outlet so as to increase pressure within the at least one air mattress chamber. In further embodiments, the motor is reversible and the boundary-layer pump is configured to perform powered dumping in addition to filling operation.

In another embodiment, the present invention provides a boundary-layer pump connected to an air mattress chamber for filling the air mattress chamber with gas. The boundary-layer pump includes: a pressure recovery chamber including a pressure recovery involute; a pump inlet for receiving gas into the pressure recovery chamber; a plurality of disks within the pressure recovery chamber; a motor for rotating the plurality of disks so as to expel gas passing through the pump inlet radially outwards along the disks and out through the pump outlet; and a pump outlet connected to the air mattress chamber.

In yet another embodiment, the present invention provides a method for using a boundary-layer pump to perform a powered dump operation. The method includes: performing a filling operation with the boundary-layer pump with a motor of the boundary-layer pump rotating in a first direction so as to expel gas from a pump inlet out through a pump outlet; closing the pump inlet and connecting an exhaust outlet to a pressure recovery chamber of the boundary-layer pump; and operating the motor of the boundary-layer pump in reverse so as to expel gas from the pump outlet out through the exhaust outlet.

BRIEF DESCRIPTION OF THE SEVERAL VIEWS OF THE DRAWING(S)

DETAILED DESCRIPTION OF THE INVENTION

Figure 1:
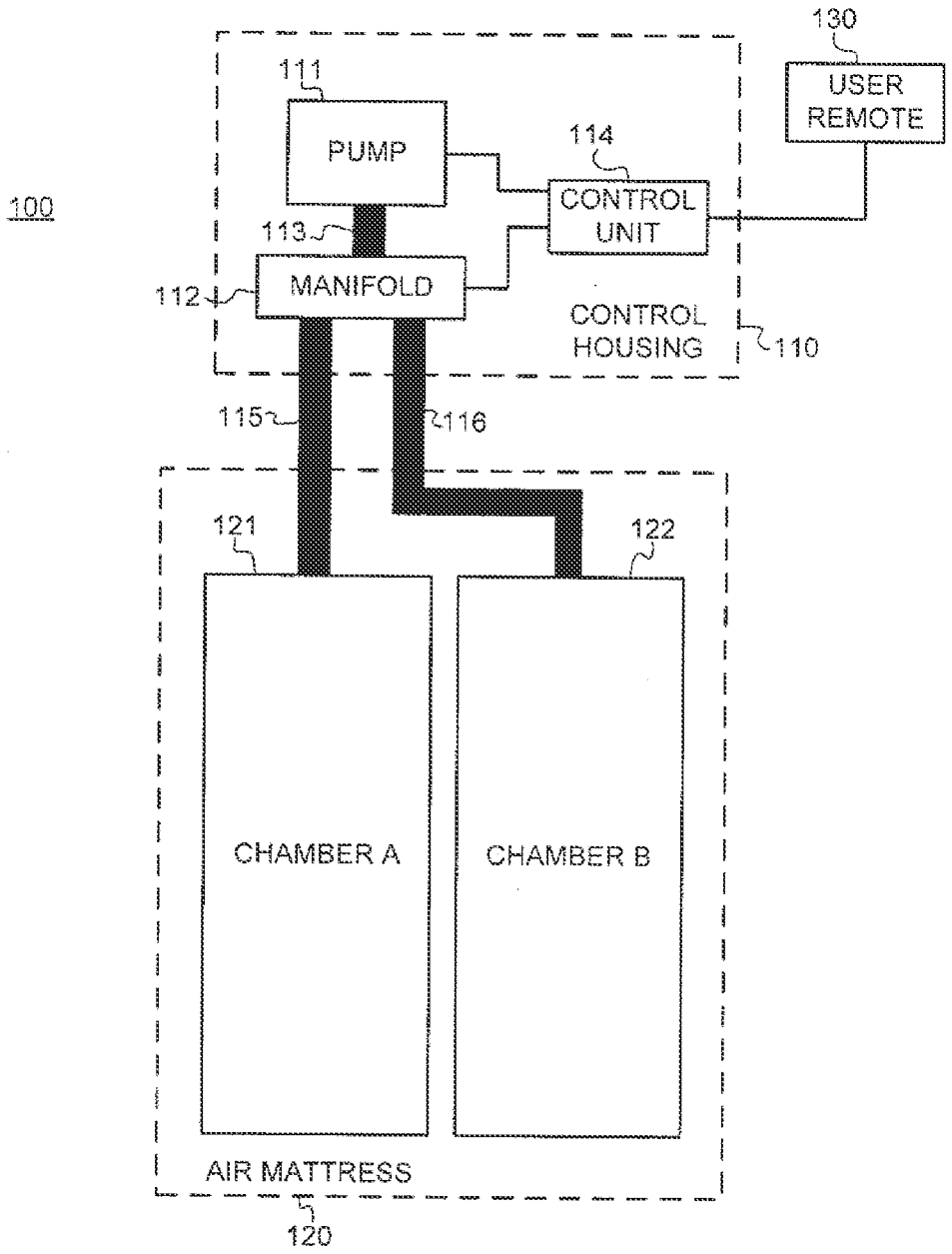
FIG. 1 is a block diagram of an airbed environment useable in embodiments of the described principles.

An exemplary airbed environment 100 in which the invention may operate is depicted by FIG. 1. It will be appreciated that the described environment is an example, and does not imply any limitation regarding the use of other environments to practice the invention. The airbed environment 100 includes a control housing 110 and an air mattress 120. The control housing further includes a control unit 114 and a pump 111, wherein the pump 111 is connected to chambers A 121 and B 122 via an appropriate connection. For example, in FIG. 1, the pump 111 may be connected to the chambers through tubes 113, 115 and 116 and a manifold 112, along with appropriate valves (not depicted). The tubes may be PVC (Polyvinyl Chloride) or silicone rubber or any other appropriate connections for transferring a gas, such as air, from a pump outlet to air mattress chambers. The manifold 112 may be manufactured out of thermoplastic or any other suitable type of material with sufficient mechanical strength to contain the amount of pressure required. For example, for applications requiring about 1 psi of air, materials such as ABS (Acrylonitrile Butadiene Styrene), PP (Polypropylene), PC (Polycarbonate), or PPE (Polyphenylene Ether), may be used. One skilled in the art will appreciate that the type of material used may vary depending on the pressure requirements of the particular application (e.g. a properly designed PPE manifold may withstand up to several hundred psi).

Valves are provided at appropriate locations, for example, at the connection between the manifold 112 and the tubes 113, 115, and 116, and the valves may be in communication with the control unit 114. Solenoid plunger style valves may be preferable due to their electromechanical control capabilities and relatively low cost, but it will be appreciated that other types of valves may be used. A pressure sensor or multiple pressure sensors (not depicted) may be connected to the manifold or valves to monitor the pressure status of the chambers, and the pressure sensor or sensors communicate with the control unit 114, providing the control unit 114 with pressure information corresponding to the manifold or the air mattress chambers.

The control unit 114 preferably includes a printed circuit board assembly (PCBA) with a tangible computer-readable medium with electronically-executable instructions thereon (e.g. RAM, ROM, PROM, volatile, nonvolatile, or other electronic memory mechanism), and a corresponding processor for executing those instructions. The control unit 114 controls the pump 111 and the flow of gas in the airbed environment through the tubes 113, 115, and 116 by opening and closing the appropriate valves. The control unit 114 may further send and receive data to and from a user remote 130, allowing a user of the airbed environment 100 to control the pumping of the air mattress 120 through the control unit 114, as well as displaying information related to the airbed environment 100 to the user. For example, an exemplary remote 130 includes a display that indicates the current pressure status of the chambers of the air mattress 120 or the current pressure target for the chambers, and also includes input buttons that allow the user to communicate the user's desired pressure settings to the control unit 114. The user remote 130 may be connected to the control unit 114 through a wired connection as depicted, or may communicate with the control unit 114 wirelessly through appropriate communications hardware.

It will be appreciated that the airbed environment 100 is merely exemplary and that the principles described herein are not limited to the environment 100 depicted. For example, it will be appreciated that in an alternative embodiment, a mattress 120 with only one chamber may be used. In other embodiments, a mattress 120 with more than two chambers may be provided, with the appropriate number of connections to those mattresses. In yet another alternative embodiment, the manifold 112 may be connected directly to the pump outlet without the use of a tube 113, and in yet another alternative embodiment, the manifold 112 may be located inside the mattress 120 instead of within the control housing 110.

Figure 2:
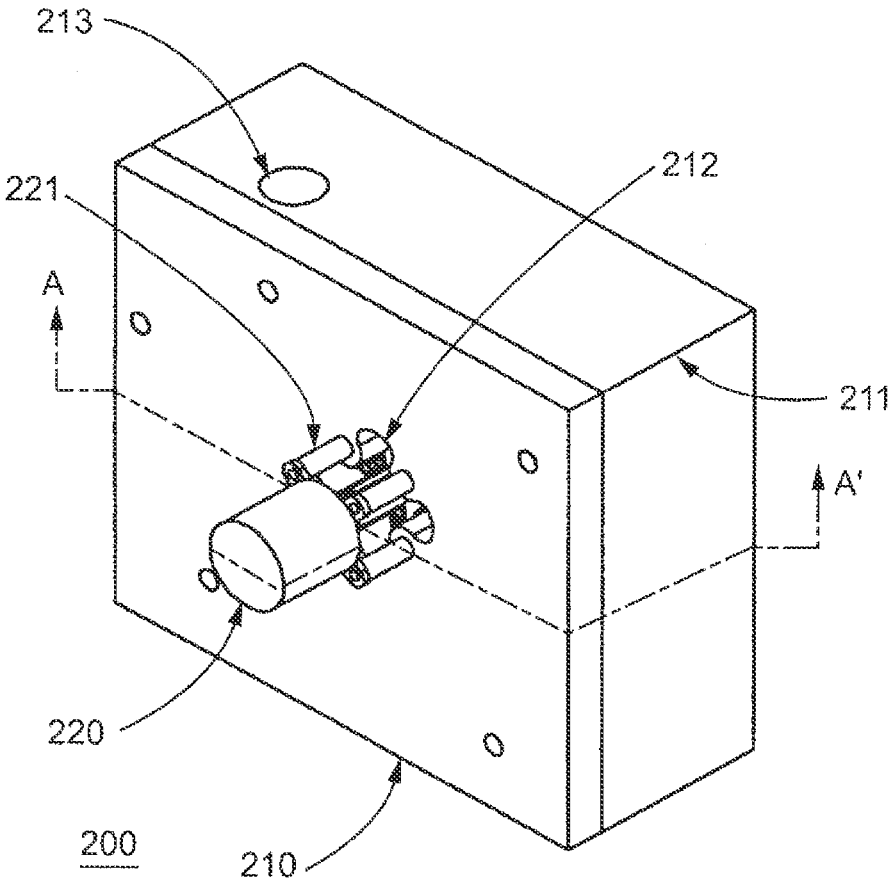
FIG. 2 is a three-dimensional (3D) schematic of an outside view of a pump according to one exemplary embodiment of the described principles.

With further reference to the environment of FIG. 1, and turning more specifically to FIG. 2, an outside view of an exemplary boundary-layer pump 200 used in an illustrative embodiment of the described principles is shown. The pump 200 includes a pressure recovery chamber housing, which further includes a pressure recovery chamber housing cover 210 and a pressure recovery chamber housing body 211. A pump inlet 212 is provided on the pressure recovery chamber housing cover 210, and a pump outlet 213 is provided on the pressure recovery chamber housing body 211. The pressure recovery chamber housing body 211 and cover 210, may be made from materials including, but not limited to, plywood, MDF (medium density fibreboard), phenolic, HDPE (high density polyethylene), mahogany, PC, and acrylic.

A motor 220 is attached to the pressure recovery chamber housing cover 210 by motor standoff rods 221, though it will be appreciated that motor standoff rods 221 are not a requirement. The motor 220 may preferably be a brushed or brushless DC (direct current) motor, or any other type of motor that generates a sufficient amount of RPMs. In one embodiment, for example, a Himax HC2812-1080KV motor may be used with a Castle Creations, Inc. Phoenix ICE 50 or Thunderbird 18 motor controller.

Figure 3:
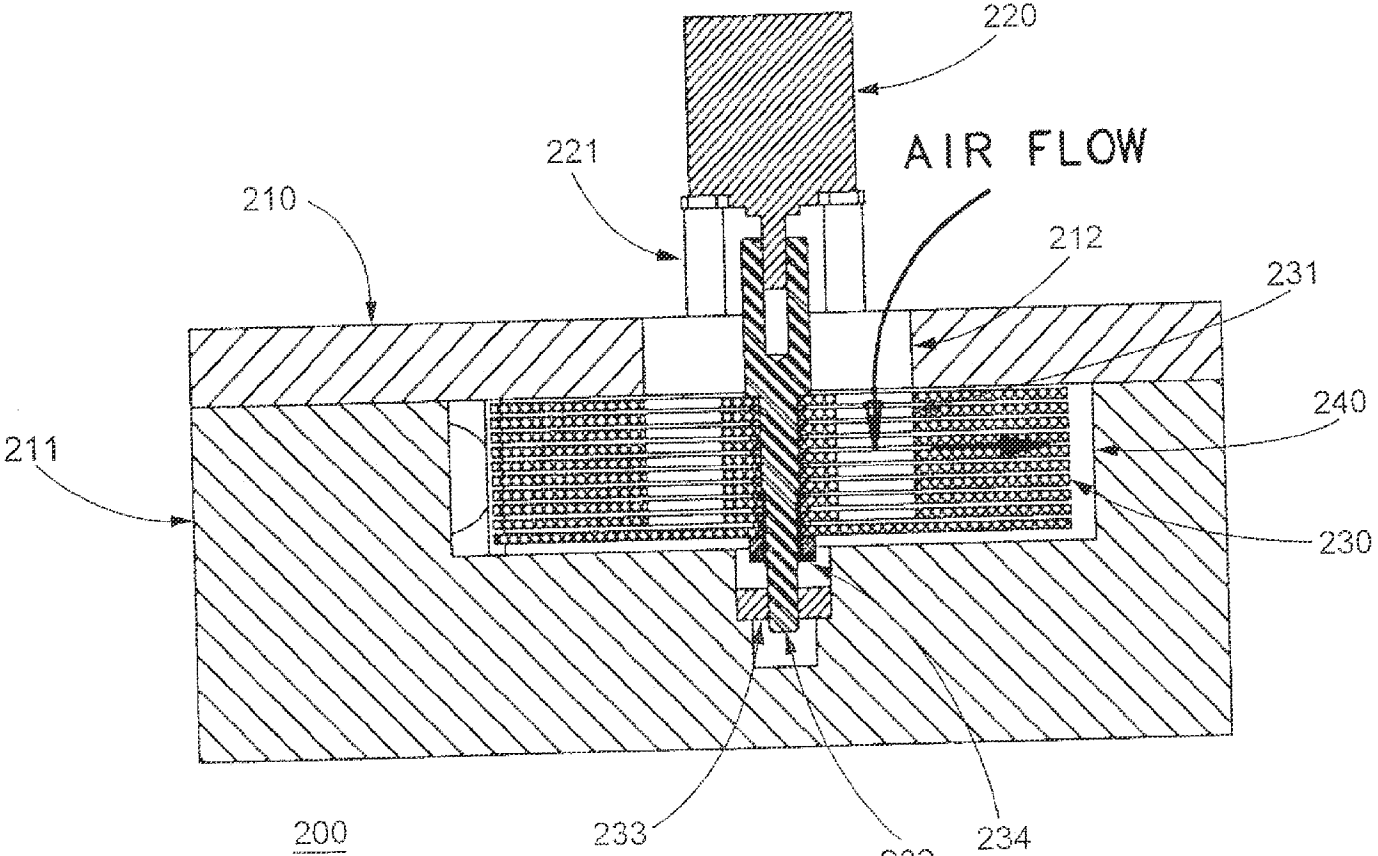
FIG. 3 is a schematic of a cross-sectional view of the pump depicted in FIG. 2.

FIG. 3 provides one cross-sectional view of the exemplary boundary-layer pump 200 along cross-sectional line A-A' of FIG. 2. The shaft of the motor 220 is connected to another shall 232, which is an arbor adapted to hold the disks 230. The arbor traverses holes at the centers of the disks 230, and is designed to hold the disks 230 in predetermined locations along the arbor. The predetermined locations are depicted as substantially evenly spaced along the arbor, but it will be appreciated that this is not a requirement. Varying the spacing of the disks, unless taken to an extreme, does not significantly affect the performance of the boundary-layer pump 200 in comparison to the other parameters discussed below. The disks 230 have holes at the center of the disks that the shaft 232 traverses. The holes may differ in size and shape according to the shape of the shaft 232. In specific embodiments, the disks may be made from materials including, but not limited to, 0.032" 2024T3 Aluminum, 0.063" Polycarbonate, or conventional compact discs (CDs), and the arbor may be machined from materials including, but not limited to, 304 Stainless Steel or 4130 Steel. In an alternative embodiment, the shaft 232 and the disks 230 may be designed as one continuous piece through an injection-molding process, and would not require holes to be present at the center of the disks.

The disks 230 and at least part of the shaft 232 are within pressure recovery chamber 240, and the shaft 232 is connected to a bottom bearing 233 and a nut 234 at the opposite end from the motor 220. The disk furthest away from the pump inlet 212 is designed with no disk inlets (this disk is called the "base disk"). Allowing gas to travel through the base disk would result in inefficiencies due to the viscous adhesion forces that would be introduced along the adjacent wall of the pressure recovery chamber, causing an increased amount of gas recirculation. A gas, which may be a homogenous or non-homogenous non-compressible fluid (e.g. ambient air), enters through the pump inlet 212 and passes through the disk inlets 231, and is drawn radially outwards from the disk inlets 231 towards the edges of the disks 231 due to the rotation of the disks 231 while the motor 220 rotates the shaft 232. The path traveled by the gas (through the pump inlets and disk inlets, and radially outward along the disks into the pressure recovery chamber and towards the pump outlet) is indicated in FIG. 3 by the bold arrows labeled AIR FLOW.

Figure 4:
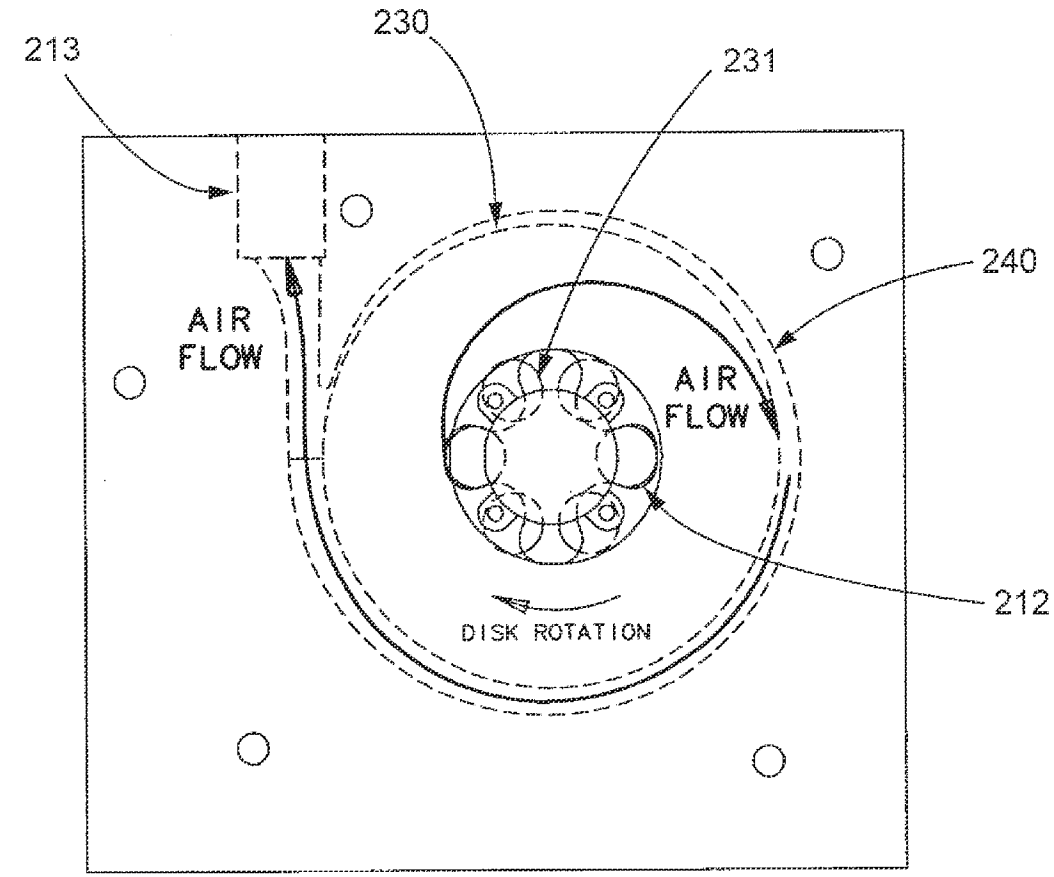
FIG. 4 is a schematic of a semi-transparent top-down view of the pump depicted in FIG. 2 from the pump inlet and motor side.

FIG. 4 provides a semi-transparent top-down view of the boundary-layer pump 200 from the side of the boundary-layer pump 200 having the motor 220 and pump inlet 212. As described above, gas enters the pump 200 through the pump inlet 212 and passes through disk inlets 231. The rotation of the disks in the direction depicted by the arrow marked DISK ROTATION causes the gas to flow radially outward along the disks 230. Gas is flung off of the disks 230 according to the velocity vector associated with the gas at the edges of the disks and is compressed in the pressure recovery involute (the area between the edge of the disks and the edge of the pressure recovery chamber 240) as it ultimately travels towards the pump outlet 213. An example of how gas may flow through the pump 200 is indicated by the bold arrows labeled AIR FLOW.

Figure 5:
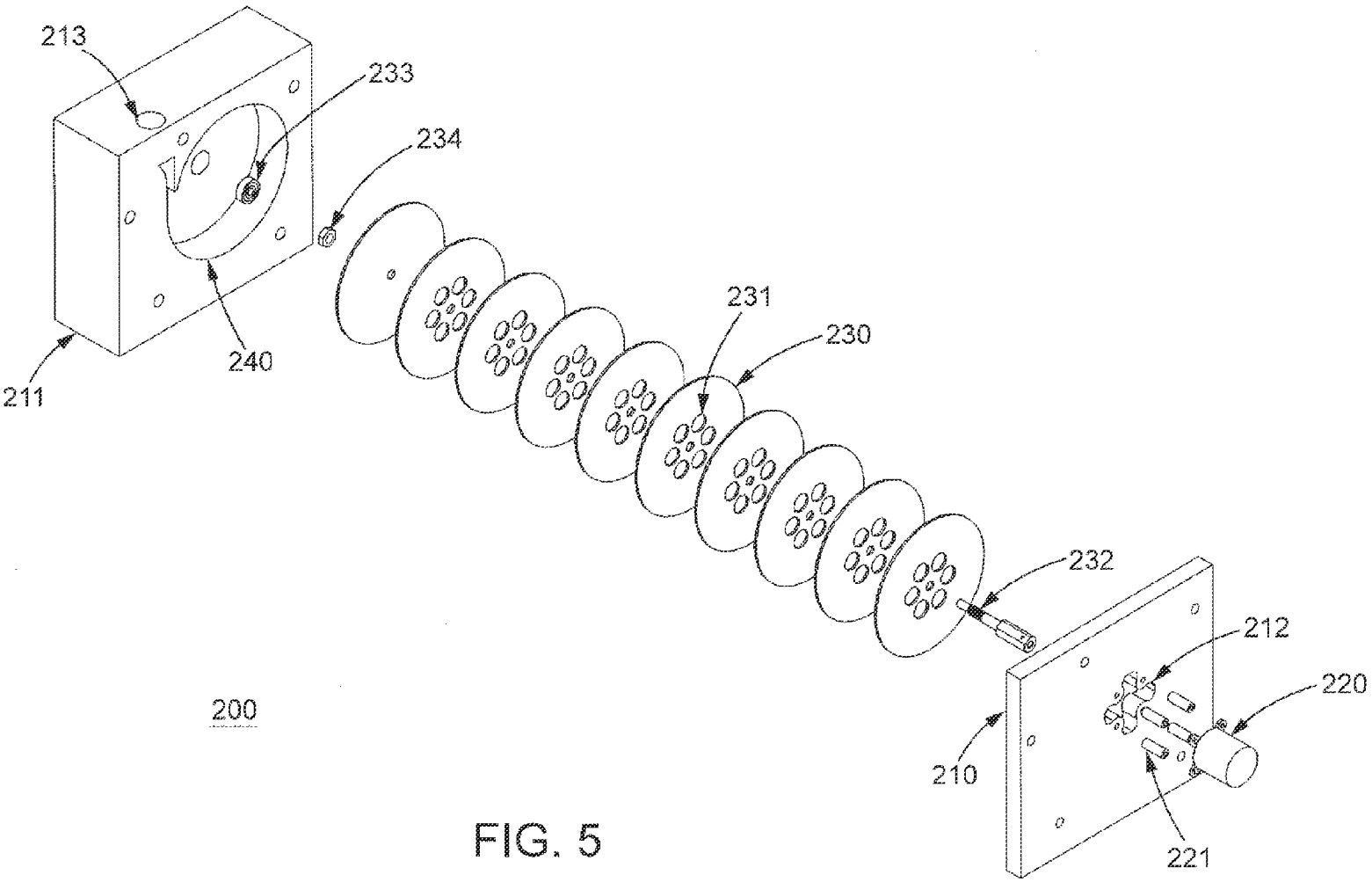
FIG. 5 is a 3D schematic of an exploded view of the components of the pump depicted in FIG. 2.

FIG. 5 provides a 3D schematic of an exploded view of the components of the boundary-layer pump 200. The motor 220, standoff rods 221, pump inlet 212, pressure recovery chamber housing cover 210, shaft 232, disks 230, disk inlet holes 231, nut 234, bearing 233, pressure recovery chamber 240, pressure recovery chamber housing body 211, pump outlet 213, and the order in which these components are arranged in one embodiment are depicted. Although FIGS. 2-5 depict the motor 220 positioned near the pump inlet 212, it will be appreciated that the motor 220 may be positioned on the other side of the pressure recovery chamber housing as well.

Figure 6:
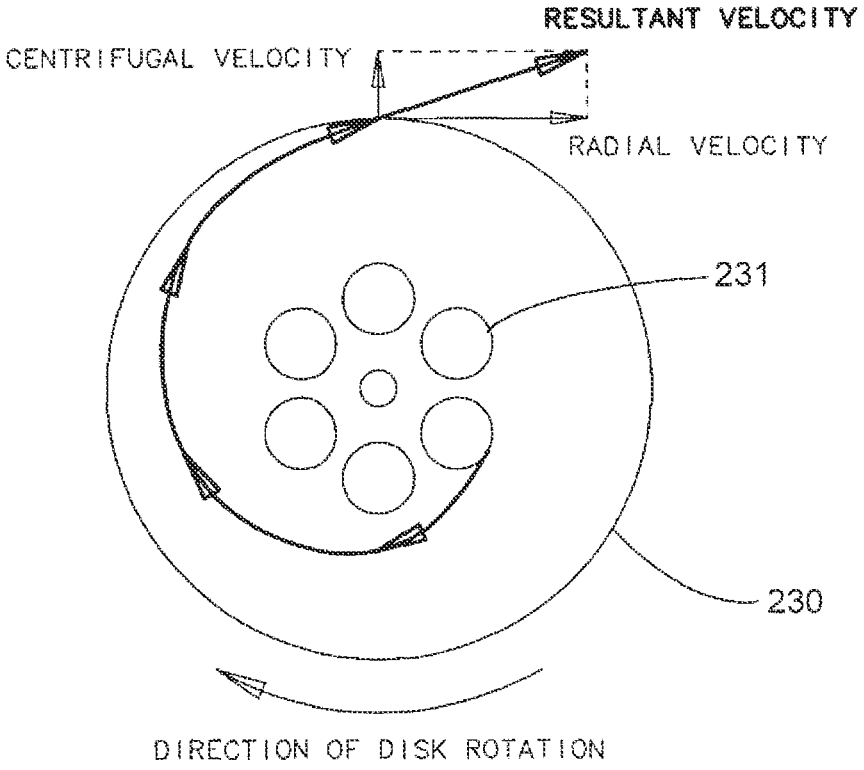
FIG. 6 is a simple vector diagram illustrating the velocity imparted to gas passing through a disk inlet hole by the rotation of the disk according to an embodiment of the described principles.

The pump 200 is referred to as a boundary-layer pump because it employs the boundary-layer effect on air surrounding spinning disks in the pump to transfer energy from the spinning disks to the air. Air, which is drawn into the pump inlet 212 due to a region of low pressure produced by the rotation of the disks 230, enters through the inlet holes 231 on the disks 230 and is subject to viscous boundary layer adhesion forces that impart a velocity profile including a centrifugal component and a radial component, as depicted by FIG. 6. The air within the boundary layer created by the rotation of the disks works it way outwards in a spiral path with the velocity profile increasing in magnitude as the air travels outward. When the air reaches the edge of the spinning disks, it is flung off of the disks and compressed against the walls of the pressure recovery chamber. The air is flung off of the disks at an angle according to the resultant velocity vector imparted to the air as depicted by FIG. 6. The rotation speed of the disks strongly influences the angle and magnitude of the resultant velocity vector shown in FIG. 6. The area between the edges of the disks and the walls of the pressure recovery chamber may be referred to as the pressure recovery involute, which may be shaped in a spiral as depicted in FIG. 4. After being flung off of the edges of the disks, the air travels towards the pump outlet along the pressure recovery involute and is further compressed by additional air being impelled off of the disks along the way and the expansion of the involute decelerating the air.

It will be appreciated that the present invention is not limited to the embodiments depicted in the drawings, and that the configuration of the pump 200 and the airbed environment 100 may be varied while remaining within the scope of the described principles. For example, the number and shape of the disks and the disk inlets may be varied, and although nine disks with six disk inlet holes are depicted in FIG. 5, the number and shape of the disks and the disk inlet holes may be varied. Another example is the configuration of the pressure recovery chamber housing, which does not necessarily require the two-piece cover and body configuration depicted, and which does not require the pump inlet and motor to be on the cover side while the pump outlet is on the body.

In further embodiments, portions of the pressure recovery chamber may be sealed or partially sealed off from each other to prevent gas recirculation within the pressure recovery chamber. By decreasing the amount of gas being recirculated within the pressure recovery chamber, the efficiency of the pump can be increased (e.g. achieving same amounts of flow and pressure with lower RPMs, less noise, and less power). One channel through which air recirculation occurs can be seen in FIG. 3, where gas flowing towards the outlet may recirculate through the space between the pressure recovery chamber housing cover 210 and the top disk of disks 230. One way of inhibiting this gas recirculation is to mount the motor 220 on the opposite side of the pressure recovery chamber, which would allow a ring to be raised up off the top disk and to be sleeved into an inlet bore, creating a conventional shaft and bore style seal. This design has the added benefit of reducing blockage of the inlet area caused by the arbor occupying space at the pump inlet 212, and further reduces the required size of the inlet hole, which allows a smaller seal to be used around the outside of the inlet hole. Another channel of gas recirculation can be seen in FIG. 4, where gas flowing near the pump outlet 213 may recirculate through the narrowest part of the pressure recovery involute and back around the pressure recovery chamber 240. Beyond constraining the distance between the edges of the disks and the pressure recovery chamber 240 at that point to a minimum (e.g. about 0.01"-0.02"), a sealing flap, such as a flap made out of Teflon, may be placed between the wall of the pressure recovery chamber 240 and the edges of the disks 230 to block the gas from recirculating.

Figure 7A:
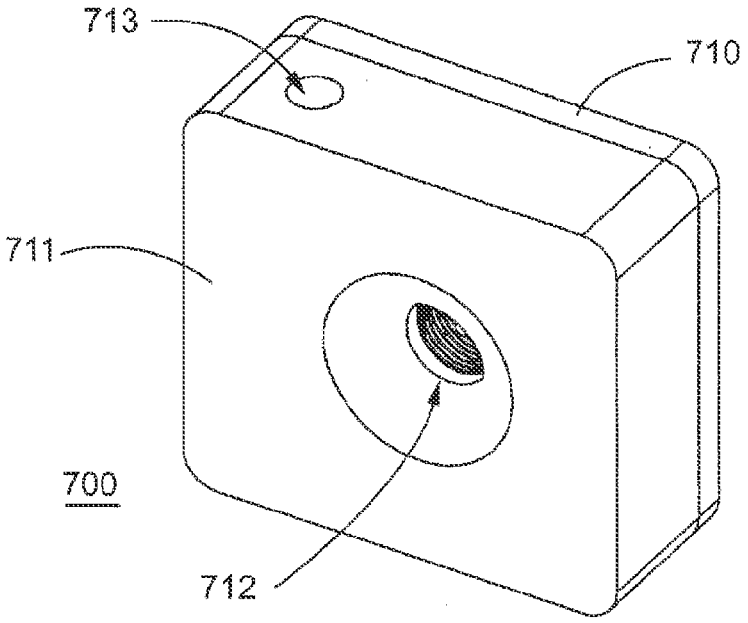
FIGS. 7A and 7B are 3D schematics of outside views of a pump according to another exemplary embodiment of the described principles.
Figure 7B:
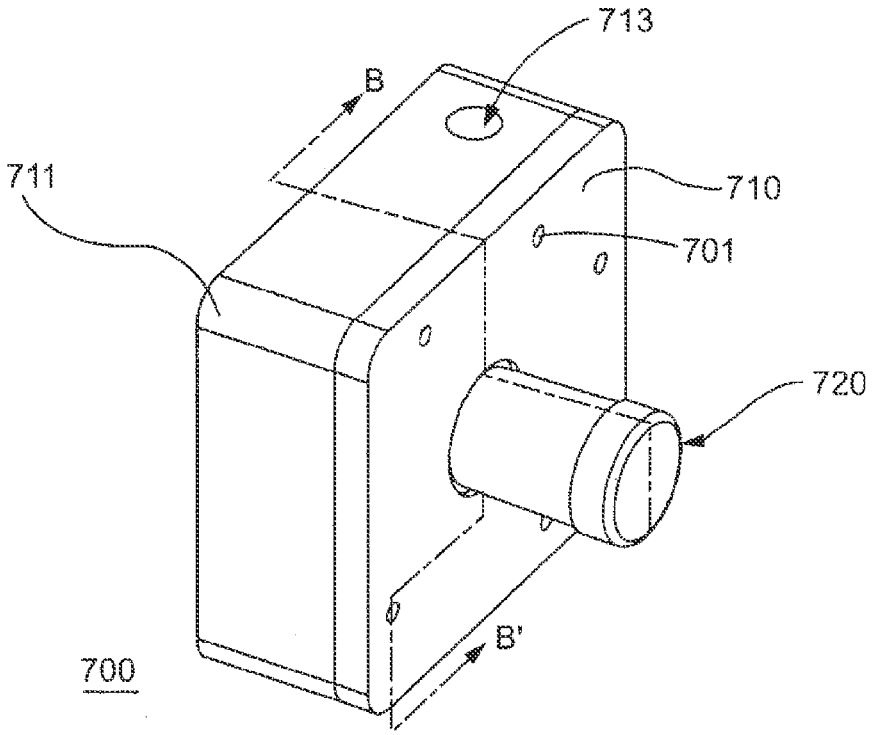

With further reference to the environment of FIG. 1, and turning more specifically to FIGS. 7A and 7B, outside views of another exemplary boundary-layer pump 700 used in another illustrative embodiment of the described principles are shown. The pump 700 includes a pressure recovery chamber housing, which further includes a pressure recovery chamber housing cover 710 and a pressure recovery chamber housing body 711. A pump inlet 712, which is bellmouth-shaped for improved gas intake rate, is provided on the pressure recovery chamber housing body 711, and a pump outlet 713 is provided on the pressure recovery chamber housing body 711. A motor 720 is attached to the pressure recovery chamber housing cover 710. It will be appreciated that motor standoff rods are not used in this exemplary embodiment. It will also be appreciated that placing the motor 720 on the side opposite from the pump inlet prevents the motor 720 from obstructing air flow through the pump inlet 712. FIG. 7B further depicts several attachment points 701 where, for example, screws can be placed to attach the pressure recovery chamber housing cover 710 to the pressure recovery chamber housing body 711.

Figure 8:
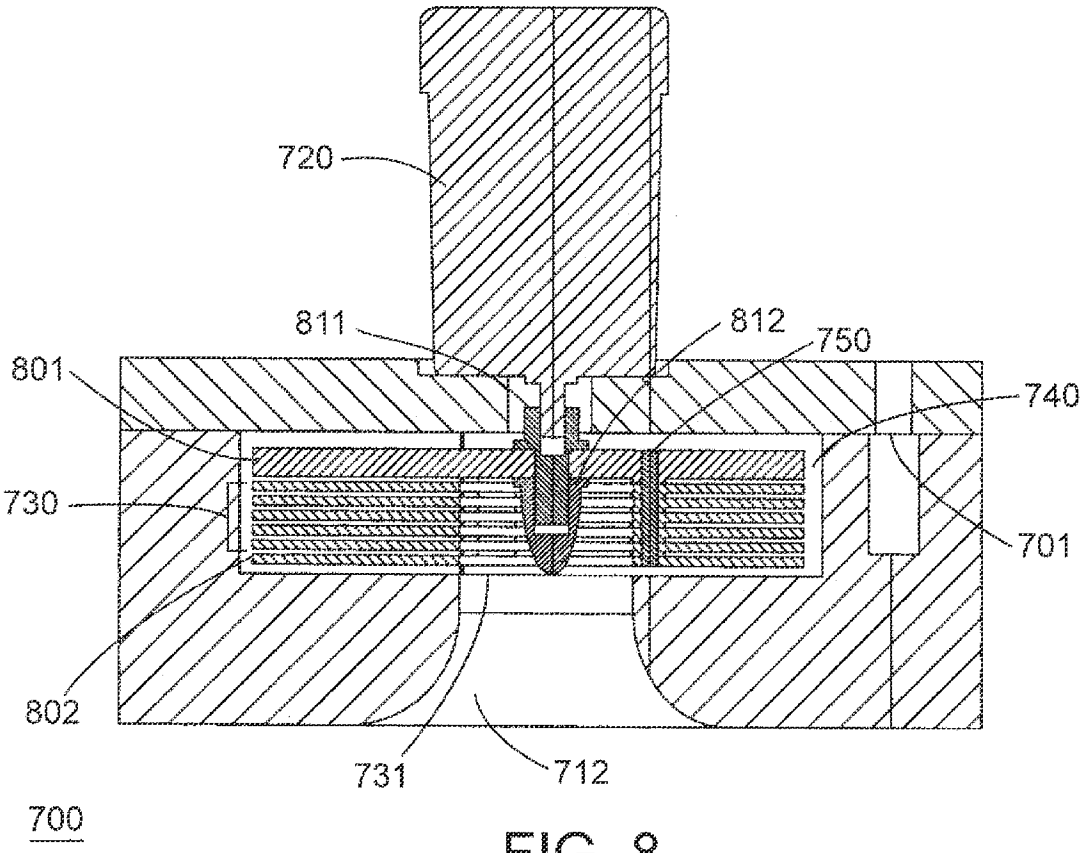
FIG. 8 is a schematic of a cross-sectional view of the pump depicted in FIGS. 7A and 7B.

FIG. 8 provides a cross-sectional view of the boundary-layer pump 700 along cross-sectional lines B-B' depicted in FIG. 7B. The motor 720 is connected to a disk assembly collet 811, which, together with collet nut 812, holds a base disk 801 that is furthest away from the pump inlet 712 in place. A disk array—including disks 730 and a "top" disk 802 (i.e., farthest from the base disk 801)—is attached to the base disk 801 by way of several disk retention pins 750 (for simplicity, only one disk retention pin 750 is depicted in FIG. 8), which will be explained in further detail with respect to FIG. 10. These pins cause the disk array to spin together with the base disk 801, which is spun by the motor 720 in combination with the disk assembly collet 811 and collet nut 812. It will be appreciated that, as shown in FIG. 8, the shape of the collet nut and uniform circular disk inlet areas 731 creates a tapered flow channel which reduces in area (from top disk 802 to base disk 801). This reduction in flow area provides a relatively more uniform flow speed through the disk array as each disk draws off an amount of air to compress. In an alternative embodiment, the base disk 801 and the disk array including disks 730 and top disk 802 are sonic-welded or otherwise bonded directly to a shaft of a motor 720, which would eliminate the need for a collet assembly. It will be appreciated that, in this alternative embodiment, the geometry of the disks would be appropriately modified to allow such welding or bonding.

In one embodiment, the top disk 802 is identical to the other disks 730. In another embodiment, the top disk 802 has a ring raised off of it which is sleeved into an inlet bore, creating a conventional shaft and bore style seal that reduces recirculation of gas flowing towards the pump outlet 713 going over the top of the top disk 802 and back towards the pump inlet 712. In yet another further embodiment, all of the disks of the disk array have different sized disk inlet areas 731. For example, in an embodiment where the base disk 801 and the disk array are bonded directly to a motor shaft, the disk inlet areas 731 are configured such that there is a reduction in inlet hole area moving from the top disk 802 to the base disk 801, so as to achieve a tapered flow channel through the disk array.

When the pump 700 is operated and the motor 720 is spinning, gas enters through the pump inlet 712, travels through a disk inlet area 731 on each disk in the disk array while also being drawn radially outwards along the disks into the pressure recovery chamber 740 and towards the pump outlet 713. For optimal performance, the motor 720 should be balanced with respect to the base disk 801 and the attached disk array. One exemplary way to balance the motor with the base disk 801 and the disk array is to selectively remove material from the base disk 801.

Figure 9:
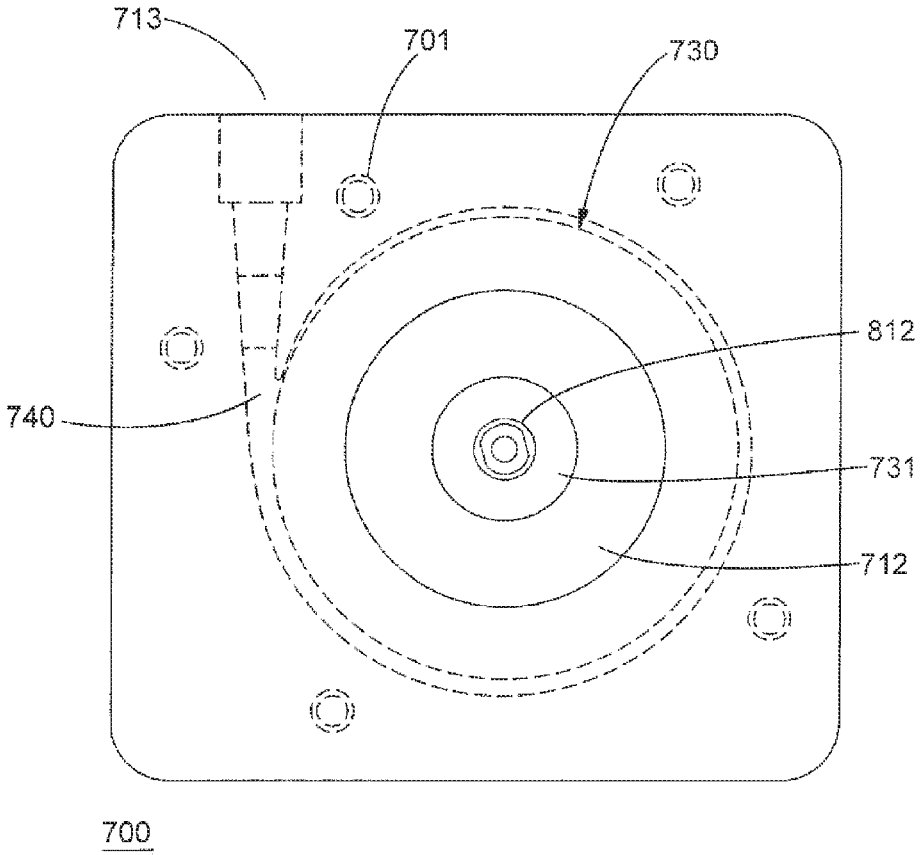
FIG. 9 is a schematic of a semi-transparent top-down view of the pump depicted in FIGS. 7A and 7B from the pump inlet side.

FIG. 9 provides a semi-transparent top-down view of the boundary-layer pump 700 from the side of the boundary-layer pump 700 having the pump inlet 712. FIG. 9 shows the relative sizes of the disks 730, pump inlet 712, disk inlet areas 731, and the collet nut 812. The space between the disks 730 and the walls of the pressure recovery chamber 740 form an involute shape that widens as it approaches the pump outlet 713. The pump inlet 712 has a bellmouth shape, the outer circumference of which is shown in FIG. 9. The tapered flow channel of the pump 700 is defined by the disk inlet areas 731 and the collet nut 812 as described above.

Figure 10:
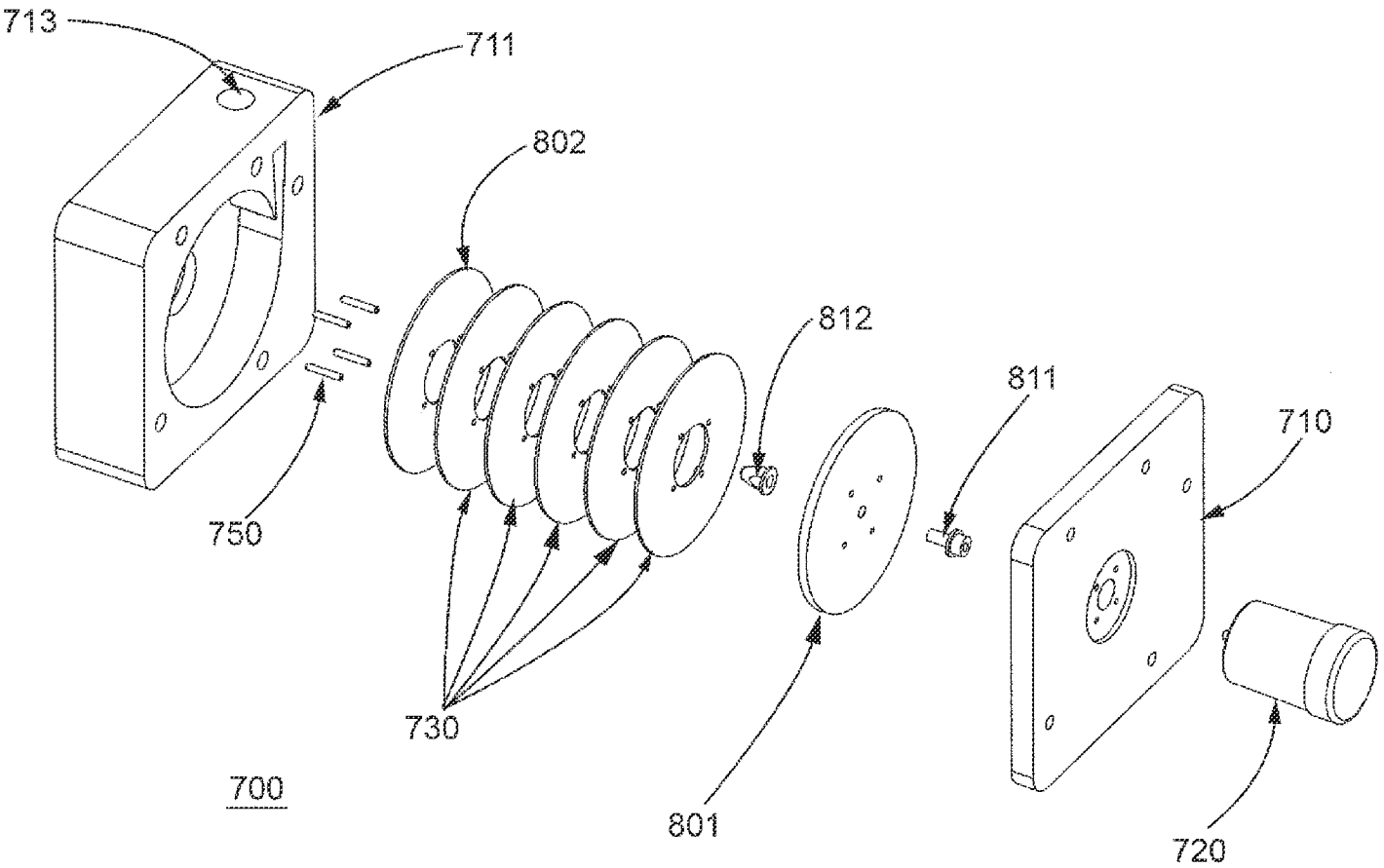
FIG. 10 is a 3D schematic of an exploded view of the components of the pump depicted in FIGS. 7A and 7B.

FIG. 10 provides a 3D schematic of an exploded view of the components of the boundary-layer pump 700. The motor 720, pressure recovery chamber housing cover 710, disk assembly collet 811, base disk 801, collet nut 812, disks 730, top disk 802, disk retention pins 750, pressure recovery chamber housing body 711, pump outlet 713, and the order in which these components are arranged in one embodiment are depicted. It will be appreciated that the disk retention pins 750 correspond to holes in the disks 730, closest disk 802, and base disk 801 and serve to hold the disk array to the base disk 801 and to transmit torque to the disk array. The disk retention pins, for example, may be glued to the disks or, in another example, may be replaced by a series of molded posts and receivers that are sonic welded together in creating the disk array and base disk.

The principles of gas flow through the pump 700 shown in FIGS. 7-10 are similar to those described above with respect to the pump 200 with respect to FIGS. 2-6. Gas enters through the pump inlet 712, travels through and along the disks of the disk array into an involute-shaped pressure recovery chamber 740, and goes out through the pump outlet 713.

Although pumps utilizing boundary-layer effects, also known as Tesla pumps, may be known to those familiar in the field of fluid mechanics and pumping technologies, these types of pumps have conventionally only been commercially implemented in large-scale liquid pumping applications, at least in part because Tesla pumps are not prone to the cavitation problems experienced with other types of liquid pumps (an advantage, that is inapplicable to the pumping of a gas). The drastic difference between the viscosities of liquids and gases, which is on the scale of two orders of magnitude (at 20° C., air has a kinetic viscosity of 1.83E-5 Pa-s while water has a kinetic viscosity of 1.00E-3 Pa-s), and the size constraints inherent to an airbed environment (liquid pumps often use disks with diameters of at least 12-18 inches, which would be too large to be commercially feasible for airbed applications) introduce serious complications into the design of a boundary-layer pump for an airbed environment. Furthermore, the relatively low pressures used in airbed environments require precise pressure control.

Given a relatively small disk size (e.g. approximately 3.7 inch diameter in one embodiment), the number of revolutions per minute (RPMs) has to be very large to generate the amount of flow and pressure desired in an airbed environment (e.g. approximately around 21,000 RPMS in one embodiment). Introducing such a high number of RPMs introduces vibration and longevity issues, as the boundary-layer pump loses efficiency and generates noise due to the vibrations, and the components of the pump affected by the high RPMs (such as the bearing at the end of the shaft) are subject to wear-and-tear considerations. The performance of the boundary-layer pump in the airbed environment is further sensitive to the relationship between the disk diameter, number of disks, operable range of RPMs and the shape/curvature of the pressure recovery involute. Furthermore, for best performance, the shape of the pressure recovery involute should be carefully matched to the disk diameter, disk quantity and operating RPM of the boundary-layer pump.

Thus, the design of boundary-layer pumps in the airbed environment requires a large number of unique considerations: the extremely low viscosity of air, the size constraints of an airbed environment, the pressure and flow required for an air mattress, the RPMs and disk size necessary to achieve those requirements, the effect of the required RPMs on the pump components, and the relationship between the radial velocity of the impelled air and the shape of the pressure recovery chamber. In one trial involving an embodiment that used ten 3.7 inch diameter disks and the pressure recovery involute shape depicted in FIG. 4, a boundary-layer pump operating at about 21,000 RPMs on about 80 Watts of power was able to output approximately 0.83 psi and more than 100 L/min in flow. A conventional squirrel-cage blower tested under the same conditions produced 20-30% less pressure and much less flow.

Figure 11:
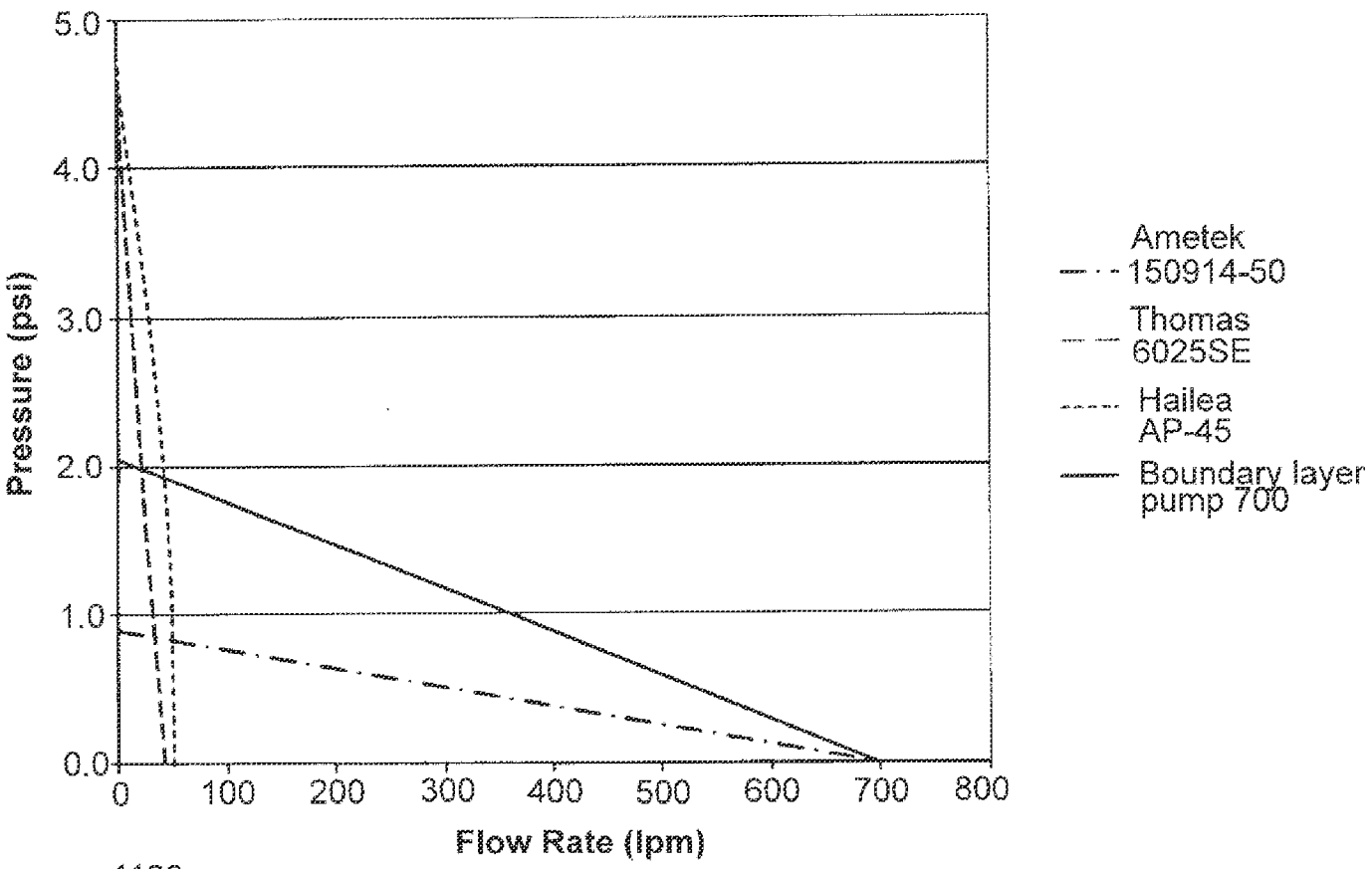
FIG. 11 is a graph showing the results of an experimental trial comparing the performance of the pump depicted in FIG. 7 with commercially available pumps.

In another trial involving a comparison of an implementation of boundary-layer pump 700 depicted in FIGS. 7-10 to commercially available pumps, the boundary-layer pump 700 was shown to outperform those commercially available pumps with respect to target flow rates and pressures for airbed applications. FIG. 11 is a graph 1100 depicting the results of this trial. The Ametek 150914-50 is an expensive high-end squirrel cage blower. The Thomas 6025SE and Hailea AP-45 are dual-acting diaphragms pumps. As can be seen from graph 1100, the boundary layer pump 700 was able to achieve much higher flow rates at target pressures suitable for airbeds (e.g., approximately from 0.1 to 1.5 psi).

In further embodiments, the previously described boundary-layer pumps are modified so as to be capable of performing a powered dump operation. Conventionally, when a user wishes to reduce the pressure in an air mattress, the control unit opens and closes valves such that the appropriate air mattress chamber or chambers is or are connected to an exhaust that vents out gas from the air mattress. During this venting, the pump remains off. However, with a powered dump operation, the described boundary-layer pumps are modified such that the pumps are turned on and used to decrease the pressure in the appropriate air mattress chamber or chambers more quickly (relative to venting).

Figure 12B:
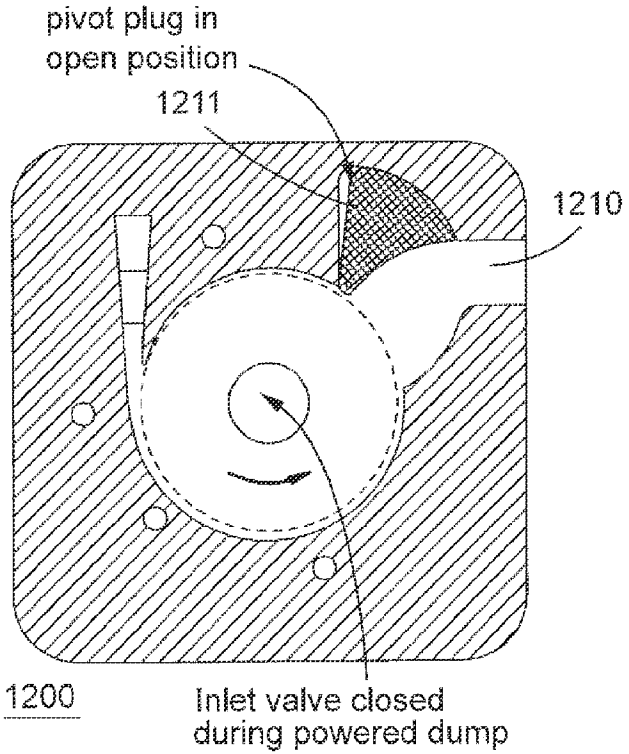
FIGS. 12A and 12B are cross-sectional views of a pump with a pivot plug configured to perform filling operation and powered dumping, respectively.
Figure 12A:
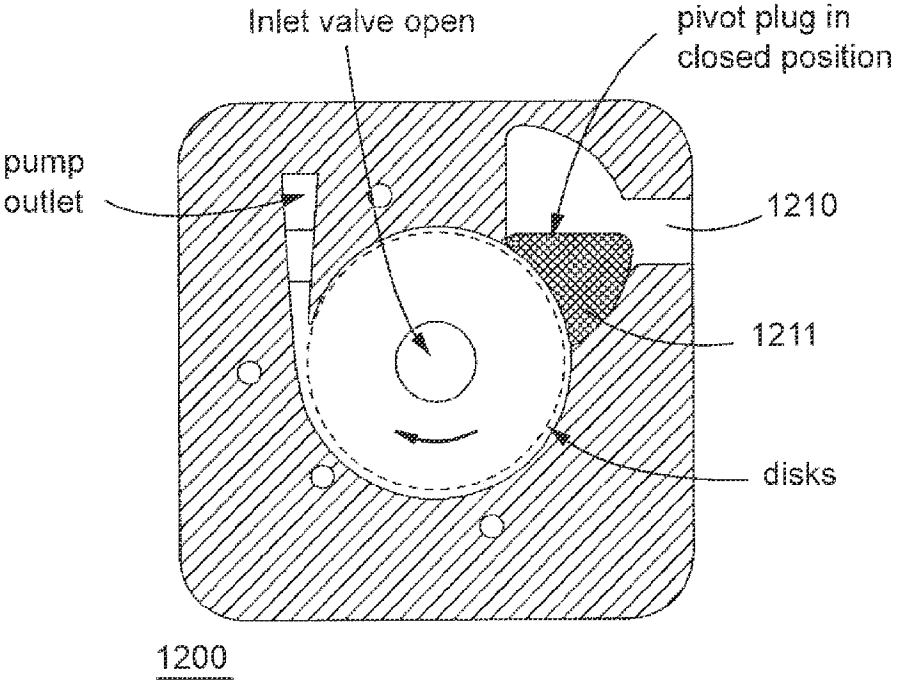

FIGS. 12A and 12B depict an exemplary boundary-layer pump 1200 capable of powered dump. The boundary-layer pump 1200 is similar to the boundary-layer pump 200 depicted in FIGS. 2-5. The direction of rotation of the shaft and disks can be reversed, for example, by reversing the polarity of the electric current being supplied to the motor, with rotation in one direction (as depicted in FIG. 12A) corresponding to filling operation and rotation in the other direction (as depicted in FIG. 12B) corresponding to powered dump operation. It will be appreciated that there are other ways of reversing the direction of operation of the motor, for example, by adjustment of a brushless motor controller. As shown in FIGS. 12A and 12B, the pressure recovery housing of pump 1200 includes an exhaust outlet 1210 in addition to the pump inlet and the pump outlet. In this embodiment, a pivot plug 1211 is positioned at the exhaust outlet 1210 such that, in a first position during filling operation, it forms part of the wall of the pressure recovery chamber and isolates the pressure recovery chamber from the exhaust outlet (as shown in FIG. 12A), and, in a second position during powered dump operation, it is positioned so as to allow gas entering the pressure recovery chamber to be expelled outwards through the exhaust outlet 1210.

It will be appreciated that, during the powered dump operation, an inlet valve associated with the pump (e.g. a flapper valve) is closed, preventing gas in the atmosphere from entering the boundary-layer pump 1200 during the powered dump operation. When the exhaust outlet 1210 is opened (through the pivot plug 1211 changing positions) and the inlet valve is closed, gas moves from the relatively high pressure region of the pump outlet into the pressure recovery chamber. The relatively low pressure region at the exhaust outlet 1210 combined with the rotation of the disks in the reverse direction (as shown in FIG. 12B), which imparts a velocity profile to gas pushed onto the disks by the relatively high pressure at the pump outlet, causes the gas to move from the pump outlet to the exhaust outlet 1210 during the powered dump operation of the boundary-layer pump 1200.

Figure 13B:
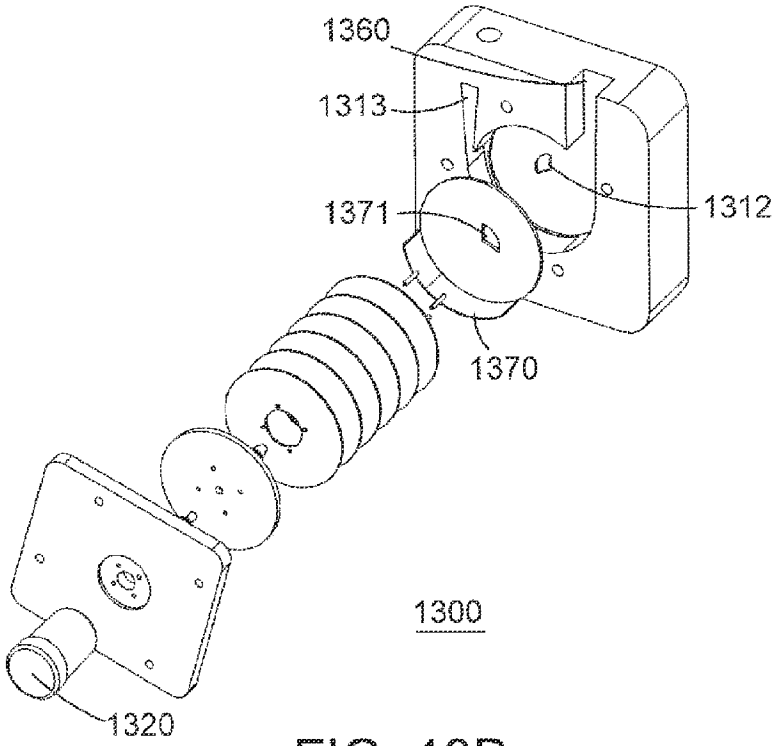
FIGS. 13A and 13B are 3D schematics of exploded views of a pump with an adjustable sheath configured to perform filling operation and powered dumping, respectively.
Figure 13A:
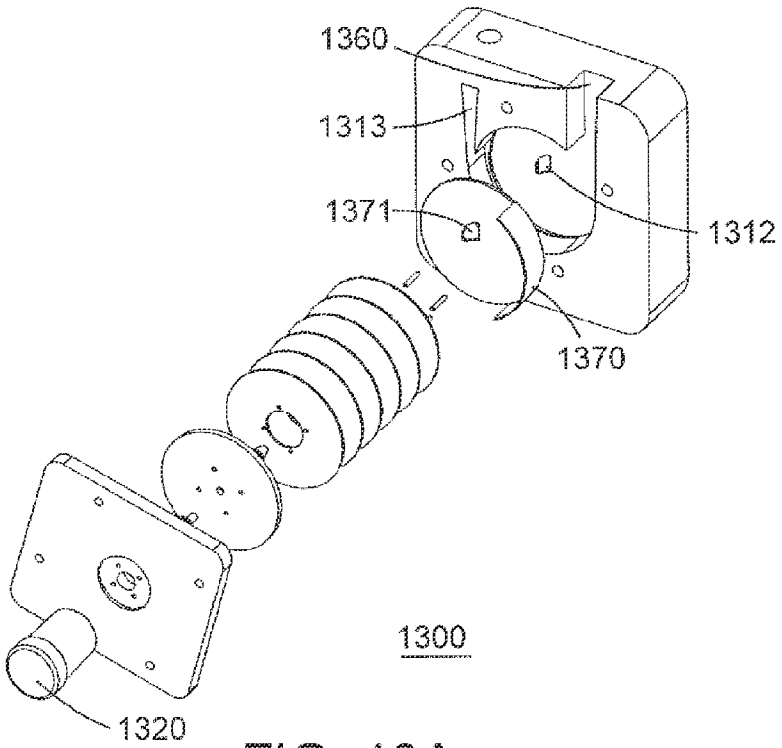
Figure 14B:
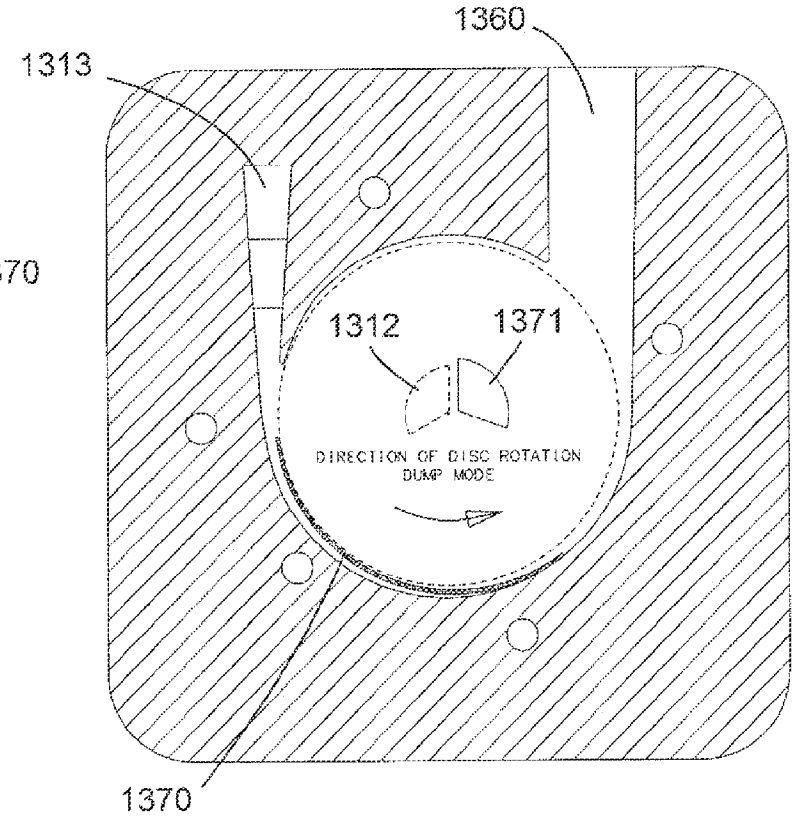
FIGS. 14A and 14B are cross-sectional views of the pump depicted in FIGS. 13A and 13B.
Figure 14A:
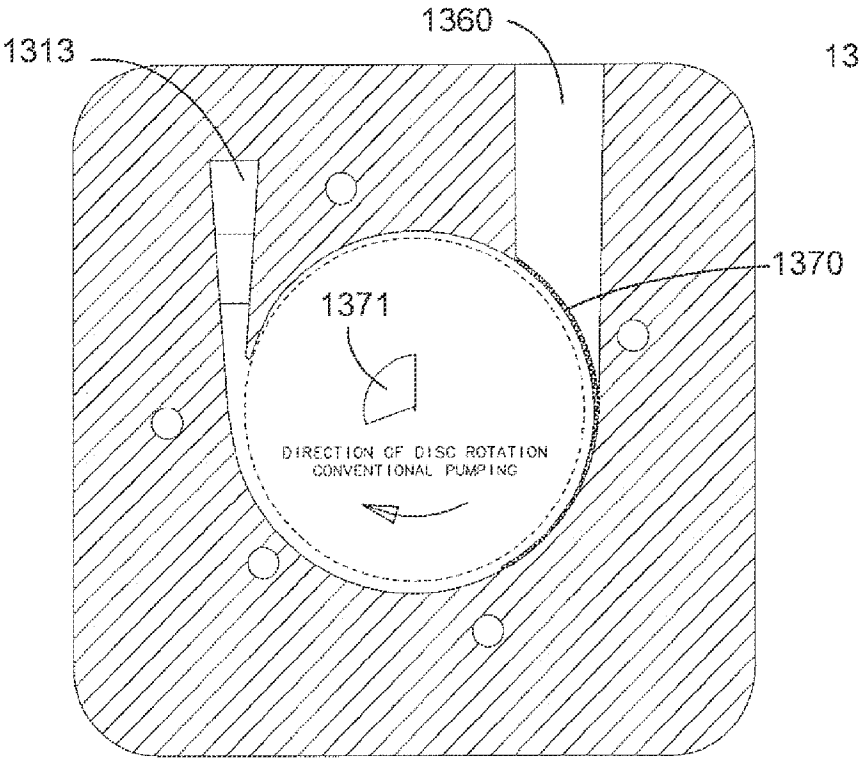

FIGS. 13A and 13B depict another exemplary boundary-layer pump 1300 capable of performing a powered dump operation. Pump 1300 is similar to pump 700 of FIGS. 7-10, but with a pump inlet 1312 that is matched to an adjustable sheath 1370. The boundary-layer pump 1300 also has a reversible motor 1320 and an exhaust outlet 1360. As shown in FIG. 13A, which is an exploded view of the components of the pump 1300 when the adjustable sheath 1370 is in position for a filling operation, the adjustable sheath 1370 is positioned such that the exhaust outlet 1360 is cut off from the pressure recovery chamber of the pressure recovery housing by the adjustable sheath 1370, and a window 1371 of the adjustable sheath 1370 is aligned with a similarly-shaped pump inlet 1312. Thus, when the motor 1320 is operated during filling operation, gas enters through the pump inlet 1312 and the window 1371, travels along a pressure recovery involute formed by the pressure recovery chamber in combination with the adjustable sheath 1370, and exits through the pump outlet 1313. Another view of the adjustable sheath 1370 in this position for filling operation is shown in FIG. 14A, which depicts a cross-section of the pump 1300 during filling operation. It will be appreciated that the size, shape, and configuration of the pump inlet 1312 and the window 1371 can be varied. The depiction of the pump inlet 1312 and the window 1371 in FIGS. 13A-B and 14A-B are merely exemplary. In other variations, the pump inlet 1312 and the window 1371 can be larger or smaller, can be a different shape, or can have a configuration involving multiple inlets and windows.

Turning to FIG. 13B, the pump 1300 is shown in a powered dump operation. In order to perform powered dump operation, the adjustable sheath 1370 is shifted into a powered dump position where the sheath 1370 is positioned such that the exhaust outlet 1360 is now exposed to the pressure recovery chamber, and the window 1371 of the adjustable sheath 1370 is no longer aligned with the pump inlet 1312, cutting off the pump inlet 1312 from the pressure recovery chamber. The direction of rotation of the motor 1320 is reversed in the powered dump mode. Thus, gas enters the pressure recovery chamber from an air mattress through the pump outlet 1313, is drawn through the pressure recovery chamber circumferentially by the spinning disk array, and is expelled through the exhaust outlet 1360. As shown in FIG. 14B, which depicts a cross-section of the pump 1300 during powered dump operation, the geometry of the pressure recovery chamber is reversed during powered dump operation, creating a pressure recovery involute that widens as it approaches the exhaust outlet 1360.

It will be appreciated that the described invention provides a quick, efficient, and cost-effective system and method for inflating an air mattress by using a boundary-layer pump, and the invention is uniquely suited to applications requiring high flow rates with low to moderate pressure requirements in homogeneous or non-homogeneous compressible fluids. Additionally, the boundary-layer pumps are capable of performing a powered dump operation. It will also be appreciated, however, that the foregoing methods and implementations are merely examples of the inventive principles, and that these illustrate only preferred techniques.

It is thus contemplated that other embodiments of the invention may differ in detail from foregoing examples. As such, all references to the invention are intended to reference the particular example of the invention being discussed at that point in the description and are not intended to imply any limitation as to the scope of the invention more generally. All language of distinction and disparagement with respect to certain features is intended to indicate a lack of preference for those features, but not to exclude such from the scope of the invention entirely unless otherwise indicated.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "inducting," and "containing" are to be construed as open-ended terms (i.e., meaning "including, but not limited to,") unless otherwise noted. Recitation of ranges of values herein are merely intended to serve as a shorthand method of referring individually to each separate value falling within, the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. An airbed system, comprising:

an air mattress having at least one air mattress chamber;

a boundary-layer pump connected to the at least one air mattress, configured to fill the at least one air mattress with gas, the boundary-layer pump comprising:

a pressure recovery chamber housing including a pressure recovery chamber, a pump inlet, and a pump outlet;

a plurality of disks within the pressure recovery chamber, wherein disks of the plurality of disks have substantially smooth top and bottom surfaces; and a motor attached to the plurality of disks, configured to rotate the plurality of disks at a rate of at least approximately 20,000 revolutions per minute (RPMs);

wherein the plurality of disks are configured such that rotation of the plurality of disks, utilizing viscous boundary layer adhesion forces, imparts a velocity profile having a centrifugal component and a radial component to gas entering the boundary-layer pump through the pump inlet so as to impel the gas radially outwards from centers of the plurality of disks towards edges of the plurality of disks based on the imparted velocity profile; and wherein the rotation of the plurality of disks at the rate of at least approximately 20,000 RPMs is configured to generate a flow rate for the gas of at least approximately 100 L/min and to generate a pressure in the at least one air mattress chamber of at least approximately 0.8 psi; and a control unit, configured to receive user input corresponding to increasing or decreasing the pressure in the at least one air mattress chamber and to control the boundary-layer pump based on the received user input;

wherein the pressure recovery chamber comprises a pressure recovery involute spanning approximately 360 degrees having a curvature defined by the edges of the plurality of disks and interior walls of the pressure recovery chamber housing, wherein the width of the pressure recovery involute, defined by the distance between the edges of the plurality of disks and the interior walls of the pressure recovery chamber housing, decreases proportionally along the pressure recovery involute from the pump outlet to a region of the pressure recovery involute farthest from the pump outlet.

2. The airbed system of claim 1, wherein the motor is a direct current motor.

3. The airbed system of claim 1, wherein the boundary-layer pump further comprises:

a base disk, positioned farther from the pump inlet than the plurality of disks.

4. The airbed system of claim 3, wherein the plurality of disks are sonic welded to the base disk.

5. The airbed system of claim 3, wherein the base disk and the plurality of disks are sonic welded to a shaft of the motor.

6. The airbed system of claim 3, wherein the base disk and the plurality of disks are held in predetermined positions relative to one another.

7. The airbed system of claim 1, wherein the curvature of the pressure recovery involute is designed for a particular disk geometry, number of disks, and an operable range of revolutions per minute.

8. The airbed system of claim 1, wherein the plurality of disks include disk inlet areas.

9. The airbed system of claim 8, wherein the disk inlet areas of the plurality of disks forms a tapered flow channel.

10. The airbed system of claim 1, wherein the motor is reversible, the boundary-layer pump is further configured to perform powered dumping, and the boundary-layer pump further comprises:

an exhaust outlet;

a plug, configured to isolate the pressure recovery chamber from the exhaust outlet in a first position during filling operation and, in a second position, to connect the pressure recovery chamber to the exhaust outlet during the powered dumping; and a valve for blocking the pump inlet during the powered dumping;

wherein the plurality of disks are further configured such that rotation of the plurality of disks in a reverse direction during powered dumping impels gas entering the boundary-layer pump through the pump outlet towards the exhaust outlet.

11. The airbed system of claim 10, wherein the pressure recovery chamber includes a first pressure recovery involute geometry during the filling operation defined by the edges of the plurality of disks, interior walls of the pressure recovery chamber housing, and the plug in the first position, and wherein the pressure recovery chamber includes a second pressure recovery involute geometry during the powered dumping defined by the edges of the plurality of disks, interior walls of the pressure recovery chamber housing, and the plug in the second position.

12. The airbed system of claim 1, wherein the motor is reversible, the boundary-layer pump is further configured to perform powered dumping, and the boundary-layer pump further comprises:

an exhaust outlet; and an adjustable sheath, configured to isolate the pressure recovery chamber from the exhaust outlet during filling operation in a first position, and further configured to connect the pressure recovery chamber to the exhaust outlet during the powered dumping and block the pump inlet during powered dumping in a second position;

wherein the plurality of disks are further configured such that rotation of the plurality of disks in a reverse direction during powered dumping impels gas entering the boundary-layer pump through the pump outlet towards the exhaust outlet.

13. The airbed system of claim 12, wherein the pressure recovery chamber includes a first pressure recovery involute geometry during the filling operation defined by the edges of the plurality of disks, interior walls of the pressure recovery chamber housing, and the adjustable sheath in the first position; and a second pressure recovery involute geometry during the powered dumping defined by the edges of the plurality of disks, interior walls of the pressure recovery chamber housing, and the adjustable sheath in the second position.

14. A boundary-layer pump connected to an air mattress chamber for filling the air mattress chamber with gas, the boundary-layer pump comprising:

a pressure recovery chamber including:

a pressure recovery involute;

a pump inlet for receiving gas into the pressure recovery chamber; and a pump outlet connected to the air mattress chamber;

a plurality of disks within the pressure recovery chamber, wherein disks of the plurality of disks have substantially smooth top and bottom surfaces; and a motor, connected to a control unit, for rotating the plurality of disks at a rate of at least approximately 20,000 revolutions per minute (RPMs);

wherein the plurality of disks are configured such that rotation of the plurality of disks, utilizing viscous boundary layer adhesion forces, imparts a velocity profile having a centrifugal component and a radial component to gas entering the boundary-layer pump through the pump inlet so as to impel the gas radially outwards from centers of the plurality of disks towards edges of the plurality of disks based on the imparted velocity profile;

wherein the rotation of the plurality of disks at the rate of at least approximately 20,000 RPMs is configured to generate a flow rate for the gas of at least approximately 100 L/min and to generate a pressure in the air mattress chamber of at least approximately 0.8 psi; and wherein the pressure recovery involute has a curvature defined by the edges of the plurality of disks and interior walls of the pressure recovery chamber housing spanning approximately 360 degrees, wherein the width of the pressure recovery involute, defined by the distance between the edges of the plurality of disks and the interior walls of the pressure recovery chamber housing, decreases proportionally along the pressure recovery involute from the pump outlet to a region of the pressure recovery involute farthest from the pump outlet.

15. The boundary-layer pump of claim 14, wherein the curvature of the pressure recovery involute is designed for a particular disk geometry, number of disks, and an operable range of revolutions per minute.

16. The boundary-layer pump of claim 14, wherein the motor is reversible and the boundary-layer pump further comprises:

an exhaust outlet;

a plug, configured to isolate the pressure recovery chamber from the exhaust outlet in a first position during filling operation and to connect the pressure recovery chamber to the exhaust outlet during powered dumping; and a valve for blocking the pump inlet during the powered dumping;

wherein the plurality of disks are further configured such that rotation of the plurality of disks in a reverse direction during powered dumping impels gas entering the boundary-layer pump through the pump outlet towards the exhaust outlet.

17. The boundary-layer pump of claim 14, wherein the motor is reversible and the boundary-layer pump further comprises:

an exhaust outlet; and an adjustable sheath, configured to isolate the pressure recovery chamber from the exhaust outlet during filling operation in a first position, and further configured to connect the pressure recovery chamber to the exhaust outlet during the powered dumping and block the pump inlet during powered dumping in a second position;

wherein the plurality of disks are further configured such that rotation of the plurality of disks in a reverse direction during powered dumping impels gas entering the boundary-layer pump through the pump outlet towards the exhaust outlet.

* * * * *